United States Patent [19]

Harrison

[11] 4,354,601

[45] Oct. 19, 1982

[54] TRAYS FOR CREDIT CARD TRANSACTIONS AND THE LIKE

[76] Inventor: Derek Harrison, Moss Nook Restaurant, Ringway Rd., Manchester, England

[21] Appl. No.: 216,316

[22] Filed: Dec. 12, 1980

Related U.S. Application Data

[63] Continuation-in-part of Ser. No. 99,514, Dec. 3, 1979, abandoned, which is a continuation-in-part of Ser. No. 11,230, Feb. 12, 1979, abandoned.

[30] Foreign Application Priority Data

Feb. 22, 1978 [GB] United Kingdom ..... 7149/78
Jun. 12, 1980 [GB] United Kingdom ..... 8019283

[51] Int. Cl.[3] ..... B65D 1/34; B65D 1/36; B65D 6/54; A45L 11/00

[52] U.S. Cl. ..... 206/564; 108/25; 294/172; D19/78; 206/232

[58] Field of Search ..... 206/214, 425, 557, 558, 206/562, 564; 108/25, 28; 294/141-144, 172; 24/67.3, 67.11; D7/38; D19/9, 22, 23, 77-86; 101/DIG. 18; 340/825.33; 40/124, 124.1, 124.2; 248/346

[56] References Cited

U.S. PATENT DOCUMENTS

D. 164,157 8/1951 Chrzanowski ..... D19/78
D. 236,677 9/1975 Pilger et al. ..... D7/38
D. 238,135 12/1975 Longobardi, Jr. ..... D7/38
240,596 4/1881 Laraway et al. ..... 206/564
D. 246,847 1/1978 Landau et al. ..... D19/78
2,230,394 2/1941 Young ..... 206/564
2,417,879 3/1947 Merritt ..... 206/564
2,640,747 6/1953 Bodenhoff ..... D7/38
2,948,391 8/1960 McLeod ..... D7/38
3,224,780 12/1965 Mohl ..... 206/564
3,736,088 5/1973 Jimenez ..... 206/564

FOREIGN PATENT DOCUMENTS 254533 7/1926 United Kingdom ..... 294/172

*Primary Examiner*—Stephen Marcus

[57] ABSTRACT

A tray-like structure is proposed for use in such as a restaurant for presenting a credit card slip to a customer for signature, the structure comprising a flat broad thin body having shallow rectangular recesses in the flat upper surface thereof to receive the credit card and the credit card slip in adjacent disposition with their left lateral edges in rectilinear alignment so that the specimen signature on the card is adjacent the signature on the signed credit card slip. Each recess or a part thereof has a depth which reduces to zero at one edge, the part may be a ramp at a corner of the recess. A pen recess, also having reducing depth towards one end, finger gripping recesses in opposed lateral edges of the tray, and a further recess opening into an edge of the body for receiving documents therein, may also be provided.

7 Claims, 7 Drawing Figures

TRAYS FOR CREDIT CARD TRANSACTIONS AND THE LIKE

This is a continuation-in-part of my co-pending U.S. patent application Ser. No. 06/099,514 filed Dec. 3, 1979, now abandoned, and which was a continuation-in-part of U.S. patent application Ser. No. 11,230 filed Feb. 12, 1979 now abandoned, both being entitled 'Trays and the Like'.

The invention concerns trays, and the like, and has more particular reference to a tray or the like for use in presenting a credit card slip to a customer for signature.

The use of credit cards in restaurants and clubs is becoming increasingly prevalent, but despite the widespread use of credit cards no satisfactory means for the presentation of the credit card slip to the customer for signature is available.

A common practice in restaurants is for the bill to be presented to the customer on a plate, salver or the like, and for the waiter to take the customer's credit card to a cash point thereat to make out the credit slip, subsequently returning to the customer for signature of the slip. The signing of the slip often gives rise to inconvenience, in view, for example, of the absence of a suitable support surface upon which to rest the slip, and of the frequent need to hand the customer a pen with which to sign the slip.

The object of the present invention is to provide a means which will facilitate the presentation, for signature, of a credit card slip, the signing of such slip and the comparison of the signatures on the slip and the card, and which will, furthermore allow of the payment of a bill by means of a credit card in a much more unobtrusive manner than has hitherto been possible.

According to the present invention there is proposed a credit card tray comprising: a generally flat, broad, thin body having a flat, upper writing surface, a lower surface and peripheral edges, said body being of predetermined thickness; said upper surface having a generally rectangular, shallow, recess for receiving and retaining a credit card substantially flatwise therein, and having a generally rectangular, shallow recess for receiving and retaining a credit card slip substantially flatwise therein, said credit card recess and said credit card slip recess having their respective shorter lateral edges in substantial rectilinear alignment so that any signature thereon may be visually compared; the depth of at least a portion of each of said credit card recess and said credit card slip recess reducing to zero at an edge of said respective recess or portion thereof.

According to a preferred feature, a further recess is provided to receive and locate a writing instrument.

According to a further feature a further recess may be provided for receiving documents such as application forms for credit cards, membership of a club or the like, in order that the customer may take one or such documents if he wishes.

The invention will now be described further, by way of example only, with reference to the accompanying drawings which illustrate one embodiment thereof and in which.

Figure 1:
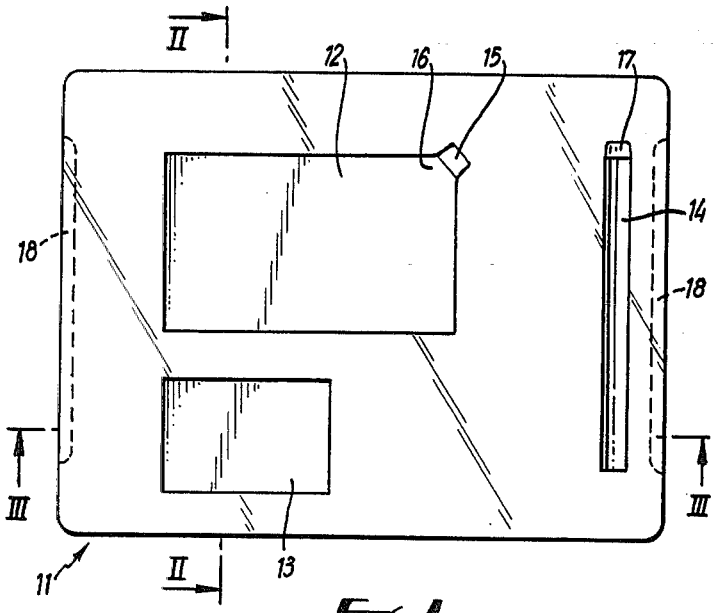
FIG. 1 is a plan view of a means constructed in accordance with the invention.
Figure 2:
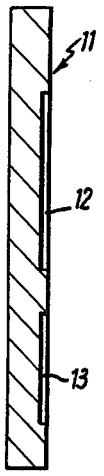
FIG. 2 is a section taken on line II—II of FIG. 1.
Figure 2A:
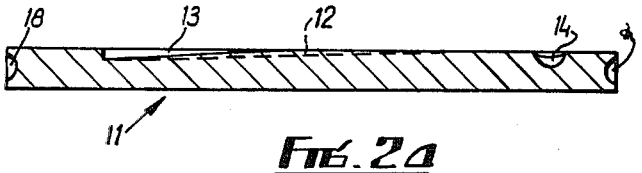
Figure 3:
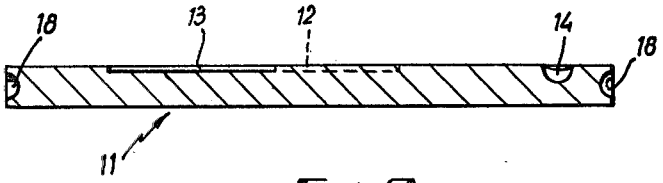
Figure 3A:
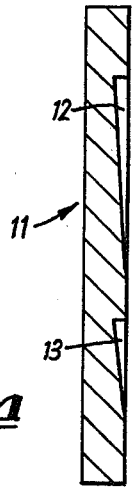
Figure 4:
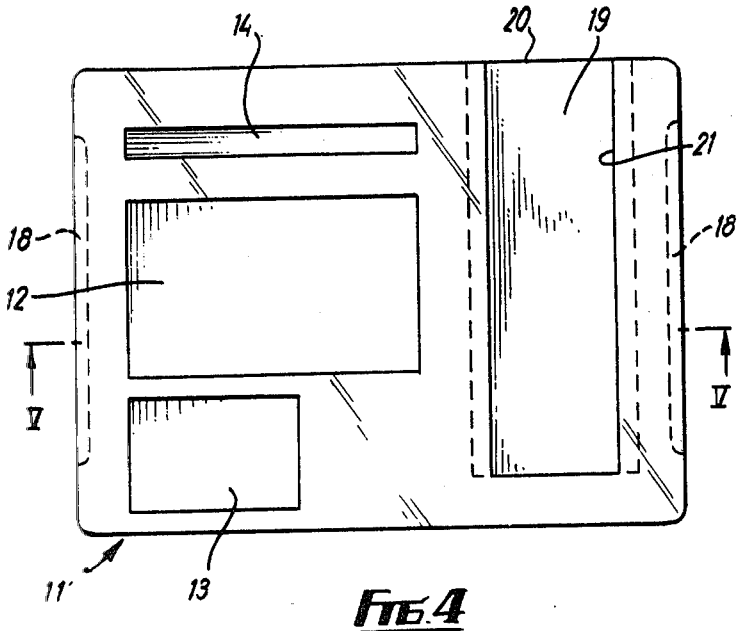

FIG. 2*a* is a section taken on a line corresponding to line III—III of FIG. 1, of an alternative embodiment;

FIG. 3 is a section taken on line III—III of FIG. 1;

FIG. 3*a* is a section taken on a line corresponding to line II—II of FIG. 1 of a third embodiment;

FIG. 4 is a plan view of a fourth embodiment; and

Figure 5:
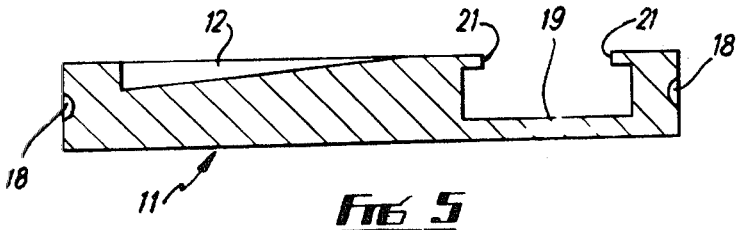

FIG. 5 is a longitudinal section on line V—V of FIG. 4.

Referring now to FIGS. 1, 2 and 3, a means for presenting a credit card slip to a customer for signature comprises a rectangular body part 11 having recesses 12, 13, 14 provided in the upper surface thereof. The body part is conveniently of polished wood, and the corners thereof are radiussed.

Recesses 12, 13 are each of shallow, rectangular form, and are of such size, when viewed in plan as to receive a credit card slip and a credit card, respectively, as a free but close fit therein. The recesses are shallow, and in the embodiment illustrated are approximately one eighth of an inch deep.

In the embodiment of FIGS. 2 and 3, ramps 15 are provided at a corner 16 of recesses 12 and 13, to facilitate removal of the slip.

Recess 14 is elongated and of arcuate transverse cross-section, such recess being intended to receive and locate a pen (not shown) into engagement therewith, the recess being approximately one quarter of an inch deep, and being of reducing depth towards one end, if preferred, thus to facilitate the gripping of a pen located therein. A ramp 17 is provided at the upper end of recess 14.

Further recesses 18 are formed in the lateral edges of the body part, to facilitate gripping of such body part.

Referring now to FIGS. 1, 2 and 2*a* or FIGS. 1, 3 and 3*a* the recesses 12 and 13 are formed having a depth of approximately one eighth of an inch at one side, as shown in FIGS. 1, 2 and 2*a* or at the top as shown in FIGS. 1, 3 and 3*a*, the depth tapering to zero at the opposed side or bottom respectively. In either of these cases the ramps 15 may not be provided. The reducing depth of the recesses enables the credit card and credit card slip to be slid out of the recess, sideways or downwardly as the case may be, in order that they may be removed in a convenient manner when the signing operation is completed. A further advantage of this construction is that, except in the case of a moulded tray, the recesses are more easily formed in the surface of the tray than in the previous embodiment in which the recess depth is constant and the ramps 15 are provided.

Referring now to FIGS. 4 and 5, in this embodiment the recesses 12, 13 and 14 are provided as in the case of the previous embodiment, and a further recess 19 is provided for receiving documents such as application forms for a credit card, membership of a club or the like or advertising handbills. Recess 19 is of constant depth and opens into the edge 20 of the tray body 11. Lips 21 are provided along two opposed upper side edges of recess 19 which is of dimensions such that it may receive and locate a plurality of documents as mentioned above. One such document may be slid from recess 19 by the customer leaving the remainder of such documents in recess 19.

In use, a credit card slip is positioned in recess 12, whilst the customer's card is located in recess 13, there being a pen in recess 14 and any documents as required in recess 19. As will be appreciated, the body part 11 provides a support surface for the customer when signing the slip, whilst the relative dispositions shown for recesses 12, 13 the left hand lateral edges thereof being in substantial alignment, will place the signature on the reverse of the credit card in closely spaced disposition relative to the customer's signature as applied to the credit card slip, thereby to facilitate comparison of such signatures by the waiter.

The arrangement as herein proposed will allow of the presentation of a credit card slip for signature, and the carrying of a credit card slip between a cash point and the customer in a convenient and unobtrusive manner, in addition to facilitating both the signing of the slip and a comparison of the signatures on the slip and card.

The invention is not restricted to the exact features of the embodiment disclosed, since alternatives will readily present themselves to one skilled in the art.

Thus, whilst it is preferred to provide a rectangular body part of polished wood, other shapes and materials could readily be used. For example, this body part could be of circular or oval form, and could be of stainless steel, silver or other material.

Instead of providing recesses in the face of a rectangular block, such recesses could be formed in the top of suitably shaped raised formations.

In the case of a metal body part, such body part could be shaped and the recesses could conveniently be formed by stamping or pressing, whilst in the case of a body part of a mouldable material, the body part could be shaped and the recesses formed during the moulding operation.

I claim:

1. A credit card tray comprising:

a generally flat, broad, thin body having a flat, upper writing surface, a lower surface, and peripheral edges, said body being of predetermined thickness;

said upper surface having a generally rectangular, shallow, recess for receiving and retaining a credit card substantially flatwise therein, and having a generally rectangular, shallow recess for receiving and retaining a credit card slip substantially flatwise therein;

said credit card recess and said credit card slip recess having their respective shorter lateral edges in substantial rectilinear alignment so that any signatures thereon may be visually compared;

the depth of at least a portion, of each of said credit card recess and said credit card slip recess reducing to zero at an edge of said respective recess or portion thereof.

2. A credit card tray as specified in claim 1 wherein said credit card recess and said credit card slip recess each have a depth which reduces to zero at one edge of said recess.

3. A credit card tray as specified in claim 1 wherein said credit card recess and said credit card slip recess each are provided with a ramp at a corner thereof, which ramp has a depth which reduces from the depth of said respective recess to zero at an edge of said ramp remote from said recess.

4. A credit card tray as specified in claim 1 wherein said body includes an elongate narrow recess in the upper surface thereof for receiving and retaining a writing instrument, said recess being of reducing depth towards one end thereof to facilitate the gripping of said instrument when located therein and having a ramp at the other end.

5. A credit card tray as specified in claim 1 wherein said body includes a pair of elongate, shallow recesses, each on an opposite lateral edge of said body and each extending in parallelism with said edge below the surface thereof for facilitating gripping of said edge with the fingers.

6. A credit card tray as specified in claim 1, said upper surface also having a generally rectangular recess, of constant depth and opening into one of said peripheral edges, for receipt of a plurality of documents therein.

7. A credit card tray as specified in claim 6, wherein said constant depth recess has two opposed edges, each of which is provided with a lip extending therealong.

* * * * *